United States Patent [19]

Tsubuko

[11] Patent Number: 4,797,341

[45] Date of Patent: Jan. 10, 1989

[54] LIQUID DEVELOPER FOR ELECTROPHOTOGRAPHY

[75] Inventor: Kazuo Tsubuko, Numazu, Japan

[73] Assignee: Ricoh Co., Ltd., Tokyo, Japan

[21] Appl. No.: 903,810

[22] Filed: Sep. 4, 1986

[30] Foreign Application Priority Data

Sep. 10, 1985 [JP] Japan ..... 60-200749

[51] Int. Cl.[4] ..... G03G 13/10

[52] U.S. Cl. ..... 430/114; 430/115; 430/119

[58] Field of Search ..... 430/111, 110, 115, 114, 430/119

[56] References Cited

U.S. PATENT DOCUMENTS

| | | | |
|---|---|---|---|
| 3,766,072 | 10/1973 | Metcalfe et al. | 252/62.1 |
| 3,893,935 | 7/1975 | Jadwin et al. | 430/110 |
| 3,933,667 | 1/1976 | Machida et al. | 252/62.1 |
| 4,032,463 | 6/1977 | Kawanishi et al. | 252/62.1 |
| 4,147,812 | 4/1979 | DeVolder et al. | 427/15 |
| 4,284,701 | 8/1981 | Abbott et al. | 430/111 |
| 4,618,558 | 10/1986 | Kuramoto et al. | 430/115 |

FOREIGN PATENT DOCUMENTS

| | | |
|---|---|---|
| 1965362 | 12/1969 | Fed. Rep. of Germany . |
| 2303670 | 2/1977 | Fed. Rep. of Germany . |
| 2641002 | 4/1977 | Fed. Rep. of Germany . |
| 2311598 | 5/1977 | Fed. Rep. of Germany . |

*Primary Examiner*—John L. Goodrow

*Attorney, Agent, or Firm*—Flynn, Thiel, Boutell & Tanis

[57] ABSTRACT

This invention relates to a liquid developer for electrophotography comprising toner particles dispersed in a highly insulative aliphatic hydrocarbon and/or halogenated hydrocarbon carrier liquid having a low dielectric constant, said toner particles having two particle size distributions of a mean small particle size in the range of 0.01 μm to 1 μm and a mean large particle size in the range of 2 μm to 30 μm, characterized in that said large toner particles in the range of 2 μm to 30 μm are prepared by using polytetrafluoroethylene as the main binder resin.

5 Claims, No Drawings

LIQUID DEVELOPER FOR ELECTROPHOTOGRAPHY

BACKGROUND OF THE INVENTION (a) Field of the Invention

The present invention relates to a liquid developer for electrophotography used for developing an electrostatic latent image.

(b) Description of the Prior Art

A liquid developer used for developing an electrostatic latent image formed by electrophotographic method, electrostatic recording method, electrostatic printing method or the like, is well known. This liquid developer generally comprises a dispersion of fine toner particles composed of coloring agents and resins as the main components in a highly insulating aliphatic hydrocarbon and/or halogenated hydrocarbon having a low dielectric constant as a carrier liquid.

Toner particles of the conventional liquid developer has a mean particle size of not larger than 1 μm and a particle size distribution having only one peak. It was generally considered that toner particles having a smaller particle size provided better resolving power. However, developed image density provided by the toner having the above mentioned average particle size and particle size distribution was limited.

Japanese Patent Laid Open No. 59-26743 discloses a developer which provides highly improved density of developed image. This developer is characterized by the toner particles having two particle size distribution peaks in the range of 0.01 μm and 1 to 30 μm. However, this developer disclosed in the above Japanese Patent Laid Open No. 59-26743 was still unsatisfactory in respect to resolving power and fixativity immediately after copying.

SUMMARY OF THE INVENTION

An object of the present invention is to provide a liquid developer for electrophotography free from the above mentioned conventional faults, which provides satisfactory properties in respects of developed image density, resolving power, reproducibility of intermediate tone, fixativity immediately after copying, dispersion stability and uniformity of density of large area image part.

That is, an object of the present invention is to provide a liquid developer for electrophotography comprising toner particles dispersed in a highly insulating aliphatic hydrocarbon and/or halogenated hydrocarbon carrier liquid having a low dielectric constant, said toner particles having two particle size distributions of a mean small particle size in the range of 0.01 μm to 1 μm and a mean large particle size in the range of 2 μm to 30 μ, characterized in that said large toner particles in the range of 2 μm to 30 μm are prepared by using polytetrafluoroethylene as the main binder resin.

DETAILED EXPLANATION OF THE INVENTION

The liquid developer of the present invention comprises toner particles dispersed in a highly insulating aliphatic hydrocarbon and/or halogenated hydrocarbon carrier liquid having a low dielectric constant, said toner particles having two particle size distributions of a mean small particle size in the range of 0.01 μm to 1 μm and a mean large particle size in the range of 2 μm to 30 μm, characterized in that said large toner particles in the range of 2 μm to 30 μm are prepared by using polytetrafluoroethylene as the main binder resin.

I have studied the developer disclosed in the above mentioned Japanese Patent Laid Open No. 59-26743. As the result of this study, I have found that the large particle size toner (mean particle size in the range of 1 to 30 μm) of this reference does not provide satisfactory properties in respects of heat resistance, chemical resistance, the coefficient of friction, non-adhesiveness, water repellency, oil repellency, resolving power, fixativity immediately after copying, and the like, and that this is because the large particle size toner of this reference comprises metals, metallic compounds, per se, such as Fe, Ni, Cu, $Fe_2O_3$, $SiO_2$, ZnO, TiO and the like, or dyes and pigments dispersed in or coated with resins such as vinyl chloride resin, styrene resin, acrylic resin, phenolic resin, maleic acid resin modified with rosin, petroleum resin, butadiene resin and the like, or glass balloon, silasu balloon, active carbon particles, dry type toner for electrophotography and the like. I have found that the above mentioned defects of the conventional toner can be remedied by preparing large particle size toners using polytetrafluoroethylene as a binder resin. The present invention has been achieved on the basis of this discovery.

The present invention is fully described hereinafter.

The migration speed of toner is generally expressed by the following formula, $$\mu = \frac{qs\ ro}{\eta}$$

u: migration speed of toner (cm/sec/V/cm)
qs: surface charge density of toner ($\mu/cm^2$)
ro: particle size of toner (μm)
$\eta$: viscosity of solvent (cps).

The migration speed of toner increases in proportion to the particle size of toner and the surface charge density of toner.

The toner particles of the present invention have two particles size distribution peaks, i.e. a mean small particle size in the range of 0.01 to 1 μm and a mean large particle size in the range of 2 to 30 μ. According to the present invention, a part of small particle size toners is adsorbed on the surface of large particle size toners, and therefore the migration speed of toner is increased, thus improving development efficiency.

However, when the large particle size toner is present in an amount of exceeding 50% by weight of the total weight of toner, the settling speed of toner becomes too high and the electric charge control by the small particle size toner becomes insufficient, thus the image density being lowered. On the other hand, when the amount of the large particle size toner is less than 1% by weight, the value of "ro" in the above formula becomes too small and accordingly the migration speed of toner becomes too low, which results in poor image density and poor uniformity.

The toner of the present invention is prepared by mixing small particle size toners and large particle size toners respectively made from coloring agents and binder resins.

An example of binder resin for the small particle size toner comprises a copolymer obtained by polymerizing a monomer expressed by the general formula, $$CH_2=\overset{\overset{\displaystyle R}{|}}{C}-A$$

(wherein R represents hydrogen or methyl group, and A represents $-COOC_nH_{2n+1}$ or $-OCOC_nH_{2n+1}$, n being an integer of 6 to 20) (hereinafter referred to as Monomer A) with divinyl benzene or its alkyl (carbon number=1 to 20) derivatives (hereinafter referred to as Monomer B) in a petroleum type aliphatic hydrocarbon or halogenated aliphatic hydrocarbon solvent.

The above mentioned copolymer can be prepared by heat-polymerizing Monomer A with Monomer B in the presence of a polymerization initiator such as benzoyl peroxide, azobisisobutyronitrile in a petroleum type aliphatic hydrocarbon or halogenated hydrocarbon solvent. This reaction provides a copolymer having network structure obtained by mutually cross-linking the both components, Monomer A and Monomer B.

Monomer B used in this reaction has properties of solvating with the above mentioned solvent before polymerization, but not solvating after polymerization. On the other hand, the above mentioned Monomer A has properties of solvating with the above mentioned solvents both before and after polymerization. Accordingly, the copolymer thus obtained is present in a solvent as a dispersion of Monomer B having Monomer A bonded therearound, the Monomer A being solvated with the solvent. The Monomer A component in the copolymer contributes to improvements on dispersion stability (i.e. preservation stability) and adhesive properties of toners. Monomers A and B are used in a weight ratio of Monomer B/Monomer A=0.01-1/1. Other polymerizable monomers (hereinafter referred to as Monomer C) may be added to Monomers A and B.

The small particle size toner of the present invention is prepared by mixing 1 part by weight of a coloring agent with 0.3-3 parts by weight of copolymer and fully dispersing the mixture in 10-20 parts by weight of petroleum type aliphatic hydrocarbon by means of an attritor, ball mill, KD-mill or the like to produce a concentrated toner. The concentrated toner may be diluted to 5 to 10 times with the same type of solvent as used above.

In this case, the above prepared copolymer dispersion comprising copolymer and solvent can be used as it is. When adjusting the viscosity of the above concentrated toner, other resins, a polarity controlling agent such as metallic soap, or the like, may be added, if necessary. As the developer obtained in the above mentioned manner has a relatively low viscosity, it provides various advantages that it is easily handled; that it can be easily and mechanically supplied for a copier; and that it is hard to be gelled or solidified during preservation.

Examples of the above mentioned Monomer A include lauryl methacrylate, lauryl acrylate, stearyl methacrylate, stearyl acrylate, 2-ethylhexyl methacrylate, 2-ethylhexyl acrylate, dodecyl methacrylate, dodecyl acrylate, hexyl methacrylate, hexyl acryulate, octyl methacrylate, octyl acrylate, cetyl methacrylate, cetyl acrylate, vinyl laurate, vinyl stearate and the like.

Examples of the above mentioned Monomer B include o-divinyl benzene, m-divinyl benzene, p-divinyl benzene, p-methyldivinyl benzene, o-ethyl divinyl benzene, p-butyldivinyl benzene, m-hexyl divinyl benzene, o-nonyldivinyl benzene, p-decyl divinyl benzene, o-undecyldivinyl benzene, p-stearyl divinyl benzene, o-methyledivinyl benzene, o-ethyldivinyl benzene, p-hexyldivinyl benzene, p-nonyldivinyl benzene, m-decyl divinyl benzene, p-undecyldivinyl benzene, o-stearyldivinyl benzene and the like.

Examples of the above mentioned Monomer C include styrene, vinyl toluene, vinyl acetate, alkyl (carbon number=1 to 5) esters of acrylic acid or methacrylic acid (for example methyl methacrylate, ethyl acrylate, methyl acrylate, ethyl metahcrylate, butyl methactrylate and the like), polyhydric alcohol esters of acrylic acid or methacrylic acid (for example ethylene glycol diacrylate, ethylene glycol dimethacrylate, diethylene glycol diacrylate, diethylene glycol dimethacrylate, triethylene glycol triacrylate, triethylene glycol trimethacrylate, butanediol diacrylate, butane diol dimethacrylate, 1,6-hexanediol diacrylate, 1,6-hexanediol dimethacrylate, trimethylol propane triacrylate, trimethylol propane trimethacrylate, tetramethylol methane triacrylate, tetramethylol methane trimethacrylate, tetramethylol methane tetraacrylate, tetramethylol methane tetramethacrylate, dipropylene glycol diacrylate, dipropylene glycol dimethacrylate, trimethylol hexane triacrylate, trimethylol hexane trimethacrylate, pentaerythritol tetraacrylate, pentaerythritol tetramethacrylate, 1,3-butylene glycol diacrylate, 1,3-cutylene glycol dimethacrylate, trimethylol ethane triacrylate, trimethylkol ethane trimethacrylate, and the like).

Examples of a polymerization initiator include benzoyl peroxide, t-butyl perbenzoate, diamyl peroxide, di-t-butyl peroxide, lauryl peroxide, azobisisobutyronitrile, and the like.

Examples of a solvent used for preparing the liquid developer for electrophotography of the present invention include petroleum type aliphatic hydrocarbons or halogented aliphatic hydrocarbons such as kerosene, ligroin, n-hexane, n-heptane, n-octane, i-octane, i-dodecane (commerically available examples of these include "Isopar" H, G, L, K; Naphtha No. 6; 'Solvesso' 100 and the like produced by Exxon Corp.), carbon tetrachloride, perfluoroethylene and the like. Aromatic solvents such as toluene, xylene and the like may be added in a small amount to these aliphatic solvents.

Powdery silica and polyolefin or wax having a softening point of 60°-130° C. may be added in the preparation step of copolymer in accordance with the present invention. The powdery silica thus added is captured by the network structure of copolymer. The silica itself is not subjected to physical changes such as dissolution and the like during the reaction. The powdery silica is effective for improving the dispersion stability of toner since it has a specific gravity close to that of aliphatic hydrocarbon or halogenated aliphatic hydrocarbon solvent used as a dispersion medium and prevents the polymer from gelling. When using wax or polyolefin, this dissolves in the reaction medium during the polymerization reaction and precipitates as fine particles by cooling after the reaction. Thus, the copolymer is present in the state of being adsorbed on or mixed with the wax or polyolefin fine particles. In the same manner as in powdery silica, wax or polyolefin has a specific gravity and molecular structure substantially similar to those of the dispersion medium and prevents the copolymer from gelling. Therefore, this is also effective for improving the dispersion stability of toner. In addition to these properties, since wax or polyolefin has a lower softening point, it is effective also for improving adhesiveness (fixativity). Silica, wax or polyolefin is suitably used in an amount of 5–200 parts by weight to 100 parts by weight of copolymer.

Examples of commercially available wax or polyolefin having a softening point of 60°–130° C. include as follows:

Examples of polyethylene

| Maker | Trade Name | Softening Point (°C.) |
|---|---|---|
| Union Carbide | DYNI | 102 |
| | DYNF | 102 |
| | DYNH | 102 |
| | DYNJ | 102 |
| | DYNK | 102 |
| Monsanto Co. | ORLIZON805 | 116 |
| | ORLIZON705 | 116 |
| | ORLIZON50 | 126 |
| Phillips Co. | MARLEX1005 | 92 |
| Du Pont Co. | ALATHON3 | 103 |
| | ALATHON10 | 96 |
| | ALATHON12 | 84 |
| | ALATHON14 | 80 |
| | ALATHON16 | 95 |
| | ALATHON20 | 86 |
| | ALATHON22 | 84 |
| | ALATHON25 | 96 |
| Allied Chemical Corp. | AC-Polyethylene1702 | 98 |
| | AC-Polyethylene6&6A | 102 |
| | AC-Polyethylene615 | 105 |
| Sanyo Chemical Industries Ltd. | Sun Wax 131-P | 108 |
| | Sun Wax 151-P | 107 |
| | Sun Wax 161-P | 111 |
| | Sun Wax 165-P | 107 |
| | Sun Wax 171-P | 105 |
| | Sun Wax E-200 | 95 |

Examples of Wax (Paraffin Wax)

| Maker | Trade Name | Softening Point (°C.) |
|---|---|---|
| Junsei Kagaku | Paraffin Wax | 60–98 |
| Kobayashi Kako | Bees Wax | 65 |
| | Cetanol | 80 |
| Nagai Kako | Bees Wax | 65 |
| Seitetsu Kagaku | Furosen | 110 |

Examples of the coloring agent used in the present invention include dyes and pigments such as carbon black, Oil Blue, Alakli Blue, Phthalocyanine Blue, Pthalocyanine Green, Spirit Black, Aniline Black, Oil Violet, Benzidine Yellow, Methyl Orange, Brilliant Carmine, First Red, Crystal Violet, and the like.

Examples of a polarity controlling agent include metallic soap, lecithin, linseed oil, higher aliphatic acid, and the like.

The above mentioned small particle size toner used in the present invention may be the conventional commerically available wet type toner (for example, Ricoh Type 1000, Ricoh Type 1700, Ricoh BS Toner, Ricoh MRP Toner and the like) as they are.

The large particle size toner used in the present invention is prepared by using polytetrafluoroethylene as mentioned above. That is, the large particle size toner comprises (a) a uniform dispersion of organic or inorganic dye or pigments in polytetrafluoroethylene; (b) granules of a cohered material of small particles of 0.1 μm to 1 μm obtained by coating dyes or pigments with polytetrafluoroethylene; or (c) a capsule-like material obtained by covering a cohered material of dye or paint with polytetrafluoroethylene.

In order that the specific gravity of toner can be controlled (preferably specific gravity=0.5 to 1.4), the large particle size toner may comprise hollow polymer particles.

The large particle size toner may be polytetrafluoroethylene particles alone without containing a pigment or dye.

Polytetrafluoroethylene provides various excellent properties in respect of heat resistance, weather resistance, chemical resistance, coefficient of friction, non-adhesiveness, water repellency, oil repellency and the like. Moreover, since its molecular weight is low and its particle size is small, it provides unique favourable properties in respects of extendability and dispersion stability. The reason why polytetrafluoroethylene has the above mentioned various favourable properties is that it has the molecular structure having a carbon chain surrounded by fluorine atoms only. That is, among organic compounds, the bonding between carbon and fluorine in polytetrafluoroethylene is the strongest, and the bonding between carbon and carbon becomes also stronger and stabler by the action of surrounding fluorine atoms as compared with those of other organic compounds.

Furthermore, fluorine atoms surrounding a carbon atom comprise a face having low surface free energy, and therefore water repellency and oil repellency are exellent.

Preferable examples of polytetrafluoroethylene used in this invention include HOSTA FLON TF-9202 (particle size=about 2.5 μm) and HOSTA FLON TF-9205 (particle size=about 5.0 μm manufactured by Hoechst Co.; SHAMROCK WAX SST manufactured by Shamrock Chemical Co.; Lubron L-2 (particle size=0.3 μm ), Lubron L-5 (particle size=10 μm), Lubron LD-1, Lubron LD-100, and Lubron LA-100 manufactured by Daikin Kogyo Co.; and the like.

The present invention is further illustrated by the following Preparation Examples of a resin dispersion of smaller particles and Working Examples, but is not limited thereto.

Preparation Example 1

300 g of isooctane was placed in a 2.0 liter four-forked flask equipped with a stirrer, thermometer and reflux cooler, and was heated to 95° C. A solution comprising 190 g of dodecyl methacrylate, 10 g of o-butyldivinyl benzene and 6 g of azobisisobutyronitrile was added dropwise to the flask for 3 hours. The resultant mixture was heated at the above temperature with stirring for further 4 hours to cause polymerization reaction, thus obtaining a resinous dispersion of a viscosity of 280 cp having a polymerization ratio of 94.8% and a particle size of 0.1 to 0.20 μ.

Preparation Example 2

300 g of the resinous dispersion prepared in the above Example 1 was mixed with 10 g of colloidal silica in a flask, and the resultant mixture was heated at 100° C. for 3 hours. After cooling, a resinous dispersion of a viscosity of 318 cp containing colloidal silica having a particle size of 0.3 to 0.4 μwas obtained.

Preparation Example 3

300 g of isododecane was placed in a flask of the same type as used in Example 1, and was heated at 90° C. A solution comprising 300 g of lauryl methacrylate, 25 g of p-divinyl benzene and 3 g of benzoyl peroxide was added dropwise to the flask for 1.5 hours. The resultant mixture was heated at 95° C. for further 4 hours with stirring to cause polymerization reaction, thus obtaining a resinous dispersion of a viscosity of 380 cp having a polymerization ratio of 96.5% and a particle size of 0.1 to 0.3 μ.

Preparation Example 4

300 g of the resinous dispersion prepared in the above Example 3 was mixed with 20 g of bees wax in a flask, and the resultant mixture was stirred at 90° C. for 2 hours. After cooling, a resinous dispersion of a viscosity of 215 cp having a particle size of 0.1 to 1.0 μ was obtained.

Preparation Example 5

300 g of Isopar G and 30 g of colloidal silica were placed in a flask of the same type as used in Example 1, and was heated to 90° C. A solution comprising 150 g of 2-ethylhexyl methacrylate, 20 g of p-divinyl benzene and 6.3 g of lauroyl peroxide was added dropwise to the flask for 3 hours. The resultant mixture was stirred at the above temperature for further 4 hours to cause polymerization reaction, thus obtaining a resinous dispersion of a viscosity of 126 cp having a polymerization ratio of 98.2% and a particle size of 0.1 to 1.0 μ.

| Example 1 | |
|---|---|
| carbon black ("M-11" manufactured by Mitsubishi Carbon Co.) | 15 g |
| resin dispersion prepared in the above Preparation Example 1 | 50 g |
| kerosene | 100 g |
| Lubron L-5 | 15 g |

The above materials were dispersed in a KD mill for 6 hours to prepare a concentrated toner having a viscosity of 25 cp. 10 g of the concentrated toner thus prepared was further dispersed in one liter of kerosene to prepare a liquid developer for electrophotography, thus obtaining a toner comprising smaller toner particles of a mean particle size of 0.28 μm and larger toner particles of a mean particle size of 10 μ.

The liquid developer thus prepared was used to make a copy on a zinc oxide photosensitive paper by a commerically available electrophotographic copier. As the result, a copy having an image density of 1.33 and an image fixativity of 83.5% was obtained, and its primary fixativity (fixativity immediately after copied) was also satisfactory.

In order to make comparison, a comparative developer was prepared in the same manner as above, except that Lubron L-5 was omitted. The comparative developer provided an image density of 1.2.

Image fixativity (%) was calculated by the formula, Y/X x 100 (wherein X represents an image density before being erased and Y represents an image density after being subjected to five reciprocating strokes of a rubber eraser tester).

| Example 2 | |
|---|---|
| carbon black ("Raven 14" manufactured by Columbia Carbon Co.) | 15 g |
| resin dispersion prepared in the above Preparation Example 2 | 100 g |
| kerosene | 100 g |
| manganese naphthenate | 1 g |

-continued

| Example 2 | |
|---|---|
| HOSTAFLON TF-9202 | 10 g |

A liquid developer for electrophotography was prepared using the above materials in the same manner as in Example 1. The concentrated toner thus obtained has a viscosity of 15 cp and comprised smaller toner particles of a mean particle size of 0.5 μm and larger toner particles of a mean particle size of 2.5 μ.

A copy was made using this toner in the same manner as in Example 1. As this result, a copy having an image density of 1.98 and an image fixativity of 83% was obtained. The resolving power of this copy was 8 lines/mm, and its primary fixativity was also satisfactory.

A copy obtained by using a comparative developer containg no HOSTAFLON TF-9202 provided an image density of 1.30 and a resolving power of 5.6 lines/mm.

| Example 3 | |
|---|---|
| carbon black ("Raven 5250" manufactured by Columbia Carbon Co.) | 15 g |
| resin dispersion prepared in the above Preparation Example 3 | 100 g |
| kerosene | 100 g |
| lecithin | 3 g |

A liquid developer was prepared using the above materials in the same manner as in Example 1. 20 g of HOSTAFLON TF-9205 was added to 200 g of the above prepared concentrated toner, and the mixture was stirred by a stirrer to prepare a toner comprising smaller toner particles of a means particle size of 0.23 μm and larger toner particles of a mean particle size of 5.0 μ.

A copy was made using the above prepared developer in the same manner as in Example 1. The copy thus obtained was used as an offset master after being subjected to desensitizing treatment. This offset master was endurable for printing at least 30,000 sheets, and the fixativity of image was 89%.

| Example 4 | |
|---|---|
| Benzidine Yellow (manufactured by Dainippon Seika) | 30 g |
| resin dispersion prepared in the above Preparation Example 4 | 70 g |
| kerosene | 100 g |
| nickel naphthenate | 5 g |
| SHAMROCK WAX SST | 10 g |

A liquid developer for color electrophotography was prepared using the above materials in the same manner as in Example 1. The concentrated toner thus obtained had a viscosity of 10.0 cp, and comprised smaller toner particles of a mean particle size of 0.8 μm and larger toner particles of a mean particle size of 20 μm.

A color copy was made on a zinc oxide photosensitive paper using the above prepared toner by a commercially available color electrophotographic copier. As this result, a color copy having an image of clear sharpness was obtained.

| Example 5 | |
|---|---|
| carbon black ("M-11" manufactured by Mitsubishi Carbon Co.) | 20 g |
| resin dispersion prepared in the above Preparation Example 5 | 130 g |
| kerosene | 100 g |
| Lubron L-5 | 30 g |

A liquid devloper for electrophotography was prepared using the above materials in the same manner as in Eample 1. The concentrated toner thus obtained had a viscosity of 20.4 cp and comprised smaller toner particles of a mean particle size of 0.18 μm and larger toner particles of a mean particle size of 5 μm.

A copy was made using this toner in the same manner as in Example 1. As this result, a copy having an image density of 1.44 and an image fixativity of 89% was obtained. The image thus obtained has a satisfactory sharpness.

A copy obtained by using a comparative developer containing no Lubron L-5 provided an image having an image density of 1.30, and the image had not satisfactory sharpness.

As can be seen from the above Examples, the liquid developer of the present invention provided an increased image density and a satisfactory fixativity immediately after copied. The fixativity immediately after copied is improved probably due to the fact that, in the system of using polytetrafluoroethylene, an amount of solvent attached to a copy paper is very small. The copy obtained by using the developer of the present invention is not damaged even if exposed to the weather because the developer of the present invention has satisfactory water repellency and weather resistance.

What we claim is:

1. A liquid developer for electrophotography comprising a coloring agent and toner particles dispersed in a highly insulating aliphatic hydrocarbon and/or halogenated hydrocarbon carrier liquid having a low dielectric constant, said toner particles having two particle size distributions of a mean small toner particle size in the range of 0.01 μm to 1 μm and a mean large toner particle size in the range of 2 μm to 30 μm, characterized in that said large toner particles in the range of 2 μm to 30 μm are prepared by using polytetrafluoroethylene as the main binder resin.

2. The liquid developer for electrophotography as claimed in claim 1, wherein said large toner particles are present in an amount of 1.0 to 50% by weight on the basis of the weight of the total toner amount.

3. The liquid developer for electrophotography as claimed in claim 1, wherein said toner particles comprise carbon black.

4. The liquid developer for electrophotography as claimed in claim 1, wherein said toner particles comprise Benzidine Yellow.

5. The liquid developer for electrophotography as claimed in claim 1, wherein kerosene is used as a solvent.

* * * * *